US005686216A

United States Patent [19]

Kubo et al.

[11] Patent Number: 5,686,216

[45] Date of Patent: Nov. 11, 1997

[54] PHOTOSENSITIVE MEMBER AND METHOD OF PRODUCING THE SAME

[75] Inventors: Kazuki Kubo; Takamitsu Fujimoto; Suguru Nagae; Toshio Kobayashi; Kazuko Wakita, all of Amagasaki, Japan

[73] Assignee: Mitsubishi Denki Kabushiki Kaisha, Tokyo, Japan

[21] Appl. No.: 557,831

[22] Filed: Nov. 14, 1995

[30] Foreign Application Priority Data

Apr. 11, 1995 [JP] Japan ..... 4-085536

[51] Int. Cl.[6] ..... G03G 5/06

[52] U.S. Cl. ..... 430/78; 430/96; 430/135

[58] Field of Search ..... 430/78, 96, 135

[56] References Cited

U.S. PATENT DOCUMENTS

| | | | |
|---|---|---|---|
| 3,816,118 | 6/1974 | Byrne | 430/78 |
| 4,284,699 | 8/1981 | Berwick et al. | 430/66 |
| 4,301,224 | 11/1981 | Kozima et al. | 430/96 |
| 5,258,252 | 11/1993 | Sakai et al. | 430/96 |
| 5,322,755 | 6/1994 | Allen et al. | 430/96 |

FOREIGN PATENT DOCUMENTS

| | | |
|---|---|---|
| 0 402 979 | 12/1990 | European Pat. Off. . |
| 1 522 636 | 9/1969 | Germany . |
| 1-169454 | 7/1989 | Japan . |
| 5-19140 | 3/1993 | Japan . |

*Primary Examiner*—Roland Martin

*Attorney, Agent, or Firm*—Oblon, Spivak, McClelland, Maier & Neustadt, P.C.

[57] ABSTRACT

An object of the present invention is to provide a photosensitive member having an excellent durability. A sensitizing solution is prepared by adding a polyester resin (resin A) synthesized using an isophthalic acid, neopentyl glycol, phthalic anhydride and adipic acid, other polyester resins, an X-form metal free phthalocyanine as a phthalocyanine type photoconductive compound and a curing agent to a solvent, and is dip-coated on a polyamide layer on an aluminum plate and then dried and cured to give a photosensitive member.

13 Claims, 4 Drawing Sheets

2 : PHOTOSENSITIVE LAYER

20 : PHTHALOCYANINE TYPE PHOTOCONDUCTIVE COMPOUND

21 : BINDER RESIN

2 : PHOTOSENSITIVE LAYER

20 : PHTHALOCYANINE TYPE PHOTOCONDUCTIVE COMPOUND

21 : BINDER RESIN

PHOTOSENSITIVE MEMBER AND METHOD OF PRODUCING THE SAME

BACKGROUND OF THE INVENTION

The present invention relates to a photosensitive member, which is used, for example, for an electrophotographic type copying machine and printer, and a method of producing it.

An electrophotographic process utilized in the copying machine, printer and the like is such a method that a photosensitive layer surface of the photosensitive member is electrically charged and then exposed to light to form an electrostatic latent image thereon, which is then made visible (developed) with a toner, and the visible image is transferred to a paper or the like and fixed thereon to give an image. Subsequently, cleaning of the surface of the photosensitive member, such as removal of the toner adhering thereto and dissipation of the charge is carried out, thus it is reused repeatedly.

Therefore, as the photosensitive member, there are required excellent properties such as electrophotographic properties, for example, excellent charging property and photosensitivity and low dark attenuation, and in addition, a small change in the above-mentioned electrophotographic properties with the lapse of time in the repeated use, excellent physical properties such as copying resistance, abrasion resistance and moisture resistance, and good chemical resistance against ozone, NOx and the like which are by-produced during the charging.

The photosensitive member has been hitherto made of inorganic materials such as selenium, cadmium sulfide and zinc oxide. Due to toxicity of such materials and because of high brightness of light source required for a higher speed copying machine and printer, that is, a longer photosensitive wavelength by the use of semiconductor laser and LED, however, organic materials such as azo type, perylene type, phthalocyanine type and quinacridone type materials have recently come to be used generally for the photosensitive member. However, the usual organic photoconductive materials are inferior in durability and stability against environmental change, as compared with the inorganic materials. In order to solve these drawbacks and problems, various researches and developments have been made, and, for example, JP-A-64040/1978, JP-A-83744/1978, and JP-A-256146/1985 propose photosensitive members using phthalocyanine type photoconductive materials. This kind of photosensitive members are produced by using a photosensitive agent wherein phthalocyanine is dispersed into a binder resin which is a mixture of polyester and polycarbonate. It is known that these photosensitive members are excellent in processability and sensitivity and the like, and are free of sanitary problems, and also show a high sensitivity even against light having a long wavelength such as semiconductor laser.

The photosensitive member using a phthalocyanine type compound (one of phthalocyanines and the derivatives thereof) usually comprises a photosensitive layer coated on an undercoat layer of an aluminum drum or on an alumite-treated aluminum drum, and the photosensitive layer comprises phthalocyanine type photoconductive compound particles dispersed in a binder resin. As the binder resin used preferably, there are polyester-melamine type resins as stated in JP-A-169454/1989. These resins are those selected to conform to the desired electric properties and initial electrophotographical properties of the photosensitive member.

The advantages of using the phthalocyanine type photoconductive compounds as the materials for the photosensitive member are well known as stated in U.S. Pat. No. 3,816,118 and JP-B-4338/1974. That is, the phthalocyanine type compounds not only have high optical absorption property, excellent heat resistance, chemical resistance and light resistance, but also are excellent in photoconductivity by irradiating light, that is, a production efficiency of electron-hole pairs.

For the photosensitive members, there are required durability in the repeated use and moisture resistance as the property against environment during the use (this moisture resistance means a life or durability of the members under highly humid environment). However, the sufficient durability and moisture resistance cannot be obtained, and thus a reliability for the photosensitive members has not yet reached the practical level when using the above-mentioned conventional organic photosensitive members containing the phthalocyanine type compound.

The present invention was made to solve those problems, and it is therefore an object of the present invention to provide a photosensitive member having an improved durability for repeated use and an enhanced reliability.

Another object of the present invention is to provide a photosensitive member being excellent in photosensitivity, charge retention ability, physical property and moisture resistance.

Still another object of the present invention is to provide a method of producing a photosensitive member being capable of reducing deterioration of electrophotographical property by ozone and being excellent in moisture resistance.

SUMMARY OF THE INVENTION

According to the first invention, the photosensitive member has a photosensitive layer comprising a phthalocyanine type photoconductive compound dispersed in a binder resin. The binder resin comprises two or more resins, and contains the particular polyester (resin A) synthesized using a phthalic acid (including phthalic anhydride), isophthalic acid, adipic acid and neopentyl glycol as essential components.

According to the photosensitive member of the second invention, the above-mentioned binder resin is so composed that the resin A: a resin (resin B) other than the resin A is 1:1 to 40.

According to the photosensitive member of the third invention, the above-mentioned phthalocyanine type photoconductive compound is incorporated in the binder resin in an amount of 15 to 40% by weight.

According to the photosensitive member of the fourth invention, the thickness of the above-mentioned photosensitive layer is from 5 to 30 μm.

According to the photosensitive member of the fifth invention, the above-mentioned photosensitive layer contains a fluorine compound.

According to the photosensitive member of the sixth invention, a silicone resin layer is provided on the above-mentioned photosensitive layer.

According to the seventh invention, the method of producing the photosensitive member comprises removing a hydroscopic substance from a dispersed phase comprising an X-form metal free phthalocyanine as a main component and then mixing and dispersing the dispersed phase into the above-mentioned binder resin to give a photosensitive layer.

In the first invention, the binder resin forming the photosensitive layer comprises two or more resins and at least one of the resins is polyester (resin A) synthesized by using phthalic acid (including phthalic anhydride), isophthalic acid, adipic acid and neopentyl glycol as the essential components. So the durability in repeated use can be enhanced with maintaining the electrophotographic property required for the photosensitive member, and thereby a stable image can be obtained even in continuous use.

In the second invention, the ratio of the resin A to the resin (resin B) other than the resin A is 1:1 to 40, so the durability in repeated use can be enhanced much more.

In the third invention, the proportion of the phthalocyanine type photoconductive compound in the binder resin is from 15 to 40% by weight, so photosensitivity and charge retention ability are excellent.

In the fourth invention, the thickness of the photosensitive layer is in the range of 5 to 30 μm, so an excellent photoresponse can be maintained and an excellent mechanical property is exhibited.

In the fifth invention, by incorporating the fluorine compound in the photosensitive layer, the lowering of resistance of the photosensitive member is inhibited and a stable image can be obtained even under a highly humid environment, and thus the moisture resistance is enhanced.

In the sixth invention, by providing the silicone resin layer on the photosensitive layer, abrasion resistance is increased and moisture absorbance through the surface of the photosensitive layer is reduced, so moisture resistance is enhanced.

In the seventh invention, by using the X-form metal free phthalocyanine, occurrence of coordination failure can be prevented, and thus oxidation is hard to occur and the deterioration of the electrophotographic property, which may be caused due to ozone generated from an electric charger to be used in the charging step of the electrophotographic process, can be reduced. Also the moisture resistance can be enhanced by removing impurities having a hygroscopic property.

Figure 1:
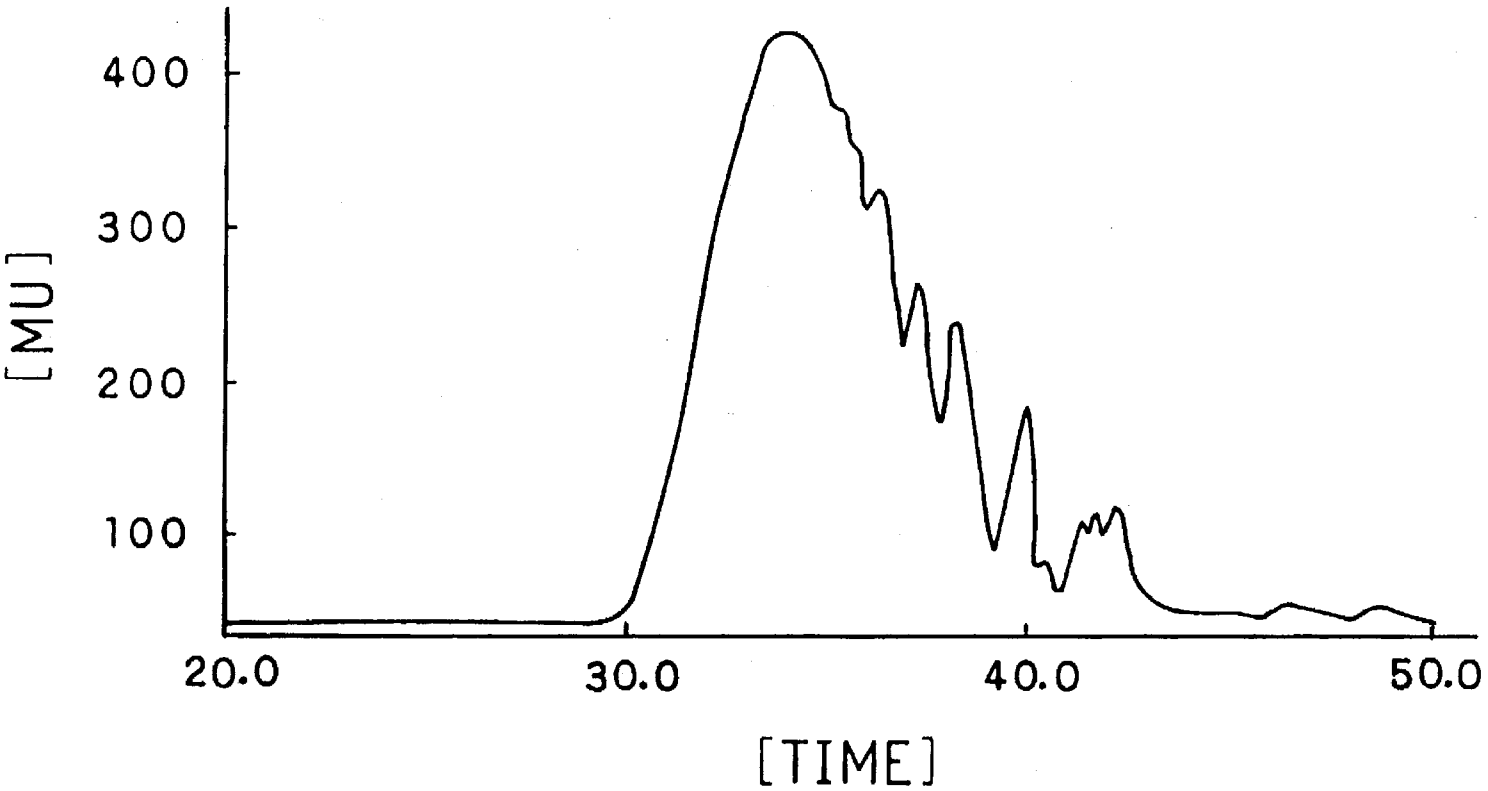
FIG. 1 is a chromatograph of gel permeation of the resin A of the present invention.

In the figure,

2 Photosensitive layer

20 Phthalocyanine type photoconductive compound

21 Binder resin

DETAILED DESCRIPTION

The binder resin for the photosensitive member of the present invention, wherein the phthalocyanine type photoconductive compound is dispersed, comprises two or more resins, and one of these resins must be polyester (resin A) synthesized using a phthalic acid (including phthalic anhydride), isophthalic acid, adipic acid and neopentyl glycol as the essential components. As the binder resin (resin B) other than the resin A, which is used in combination with the resin A, there are used usual ones featured by having an excellent charge retention and being a good dispersing medium for the phthalocyanine type photoconductive compound. Further from the viewpoint of ozone resistance, it is preferable that the resin B is one having few ionic and radical active materials and neither dissolving nor swelling at the time of treating a reactive monomer or an oligomer. As such resins, there may be used a saturated polyester resin, acrylic resin, urethane resin, butyral resin, polycarbonate resin or a combination thereof.

It is desirable that the blending ratio of the resin A to the resin B is 1:1 to 40. In the ratio out of this range, the electrophotographic properties deviate from those required for the photosensitive member in case of repeated use. Further in order to allow an excellent electrophotographic property, it is desirable that the above-mentioned ratio is in the range of 1:1 to 10.

Also there may be used a melamine resin, urea resin, amino resin or isocyanate resin as a curing agent, if needed.

In the photosensitive member of the present invention, it is desirable that the phthalocyanine type photoconductive compound is incorporated in the binder resin in an mount of 15 to 40% by weight. If the mount to be incorporated is less than the above range, photosensitivity lowers, and if it is larger than the above range, a bulk resistance of the photosensitive member lowers and charge retention ability lowers. The most preferable range is from 20 to 30% by weight from the viewpoint of both the photosensitivity and the charge retention ability.

Also as the above-mentioned phthalocyanine type photoconductive compounds, it is preferable to use ones stated in JP-B-4338/1974 and so on. Examples of such compounds are aluminum phthalocyanine, aluminum polychlorophthalocyanine, antimony phthalocyanine, barium phthalocyanine, beryllium phthalocyanine, cadmium phthalocyanine, cadmium hexadecachlorophthalocyanine, calcium phthalocyanine, cerium phthalocyanine, chromium phthalocyanine, cobalt phthalocyanine, cobalt chlorophthalocyanine, copper 4-bromochlorophthalocyanine, copper 4-aminophthalocyanine, copper bromochlorophthalocyanine, copper 4-chlorophthalocyanine, copper 4-nitrophthalocyanine, copper phthalocyanine sulfonate, copper polychlorophthalocyanine, deuteriophthalocyanine, dysprosium phthalocyanine, erbium phthalocyanine, europium phthalocyanine, gadolinium phthalocyanine, gallium phthalocyanine, germanium phthalocyanine, hafnium phthalocyanine, halogen substituted phthalocyanine, holmium phthalocyanine, indium phthalocyanine, iron phthalocyanine, iron polyhalophthalocyanine, lanthanum phthalocyanine, lead phthalocyanine, lead polychlorophthalocyanine, cobalt hexaphenylphthalocyanine, copper pentaphenylphthalocyanine, lithium phthalocyanine, lutecium phthalocyanine, magnesium phthalocyanine, manganese phthalocyanine, mercury phthalocyanine, molybdenum phthalocyanine, naphthalocyanine, neodymium phthalocyanine, nickel phthalocyanine, nickel polyhalophthalocyanine, osmium phthalocyanine, palladium phthalocyanine, palladium chlorophthalocyanine, alkoxyphthalocyanine, alkylaminophthalocyanine, alkylmercaptophihalocyanine, aralkylaminophthalocyanine, aryloxyphthalocyanine, arylmercaptophtlalocyanine, copper phthalocyanine, piperidine phthalocyanine, cycloalkylaminophthalocyanine, dialkylaminophthalocyanine, diaralkylaminophthalocyanine, dicycloalkylaminophthalocyanine, hexadecahydrophthalocyanine, imidomethylphthalocyanine, 1,2 naphthalocyanine, 2,3 naphthalocyanine, octaazaphthalocyanine, sulfur phthalocyanine, tetraazaphthalocyanine, tetra-4-acetylaminophthalocyanine, tetra-4-aminobenzoylphthalocyanine, tetra-4-aminophthalocyanine, tetrachloromethylphthalocyanine, tetradiazophthalocyanine, tetra-4,4-dimethyloctaazaphthalocyanine, tetra-4,5-diphenyloctaazaphthalocyanine, tetra-(6-metylbenzothiazoyl) phthalocyanine, tetra-p-methylphenylaminophthalocyanine, tetramethylphthalocyanine, tetra-naphthotriazolylphthalocyanine, tetra-4-naphthylphthalocyanine, tetra-4-nitrophthalocyanine, tetra-peri-naphthylene-4,5-octaazaphthalocyanine, tetra-2,3-phenyleneoxide phthalocyanine, tetra-4-phenyloctaazaphthalocyanine, tetraphenylphthalocyanine tetracarboxylic acid, tetraphenylphthalocyanine, tetrabarium carboxylate, tetraphenylphthalocyanine tetra-calcium carboxylate, tetrapyridyphthalocyanine, tetra-4-trifluoromethylmercaptophthalocyanine, tetra-4-trifluoromethylphthalocyanine, 4,5-thionaphtheneoctaazaphthalocyanine, platinum phthalocyanine, potassium phthalocyanine, rhodium phthalocyanine, samerium phthalocyanine, silver phthalocyanine, silicone phthalocyanine, sodium phthalocyanine, sulfonated phthalocyanine, thorium phthalocyanine, thulium phthalocyanine, tin phthalocyanine, tin chlorophthalocyanine, titanyl phthalocyanine, hydroxygallium phthalocyanine, metal free phthalocyanine, and the like and optional and proper mixture thereof. Also in combination of or instead of these phthalocyanines, there are used dimers, trimers, oligomers, polymers, copolymers or mixtures of optional and proper phthalocyanines.

Also among the phthalocyanine type photoconductive compounds, it is preferable to use metal free phthalocyanines having an X-form of crystal. In the metal phthalocyanine, though it is ideal that electrical neutrality thereof is maintained by coordination of a phthalocyanine to a metal, actually the metal phthalocyanine is susceptible to a coordination failure, so an oxidation easily occurs there due to ozone. On the contrary, in case of a metal free phthalocyanine, hydrogen atoms of small volume are only coordinated, and the coordination failure is hard to occur. Also from a point of high sensitivity, titanyl phthalocyanine, hydroxygallium phthalocyanine and the like are used preferably.

In the dispersed phase containing, as the main component, the X-form metal free phthalocyanine to be used in the method of producing the photosensitive member of the present invention, there is used the X-form metal free phthalocyanine containing impurities in order to obtain a high photoconductivity. This is because it is known that the X-form metal free phthalocyanine containing the impurities has a higher photoconductivity than the purified one. However the above-mentioned X-form metal free phthalocyanine contains impurities other than those relating to the photoconductivity. Particularly impurities having a hygroscopic property are present in the metal free phthalocyanine and becomes a cause for lowering an electrophotographic property under highly humid environment. Therefore the electrophotographic property under highly humid environment can be enhanced by removing a hygroscopic substance from the dispersed phase containing the X-form metal free phthalocyanine as the main component and then dispersing the dispersed phase into the binder resin.

The removal of a hygroscopic substance is carried out by cleaning the above-mentioned X-form metal free phthalocyanine by dispersing the X-form metal free phthalocyanine powder in a solvent, stirring by a propeller stirrer for about 30 minutes and then removing the solvent by a centrifugal separator. As the solvent to be used, there are, for example, toluene, tetrahydroxyfuran (THF), methanol and the like, but the solvent is not limited thereto. This cleaning step is followed by a drying step. For drying, there are used general drying methods such as vacuum drying, reduced pressure drying and other usual hot air drying.

It is desirable that the thickness of the photosensitive layer of the photosensitive member of the present invention is in the range of 5 to 30 μm. If the thickness is less than 5 μm, charge retention ability lowers and pin holes become easy to arise, and thereby mechanical properties, for example, copying resistance lowers remarkably. Also on the contrary, it is not economical if the thickness is larger than 30 μm, since photoresponse speed becomes insufficient and an amount of expensive photoconductive materials to be used increases. The most preferable thickness is from 10 to 25 μm in consideration of the charge retention ability, photoresponse speed and the like.

With regard to the photosensitive layer having the above-mentioned thickness, the phthalocyanine type photoconductive compound is usually mixed with the binder resin and solvent and dispersed by a paint shaker, and in addition, may be dispersed by means of a ball mill, disperser or the like. The photosensitive layer is formed on the surface of the aluminum drum or the like having an undercoat layer by a dipping method, spraying method and the like.

Also as the electrically conductive supporting body, there is used an electric conductor or an insulating material subjected to an electrically conductive treatment, for example, metals such as Al, Ni, Fe, Cu and Au and their alloys, ones wherein film-like electrically conductive materials, for example, metals such as Al, Ag and Au, metal oxides such as $In_2O_2$ and $SnO_2$ or the like are formed on the insulating substrate made of, for example, polyester, polycarbonate, polyimide, glass or the like, or papers being subjected to the electrically conductive treatment. Also the shape of the electrically conductive supporting body is not particularly limited, and there is used one in the form of a drum, plate or belt if needed.

Also in the photosensitive member of the present invention, an undercoat layer and intermediate layer can be used, and it is known that these layers function as a barrier for making the electrical properties stable and can function to improve adhesivity for enhancing mechanical properties.

As the fluorine compounds for the photosensitive layer of the photosensitive member in Examples of the present invention, there are used one or more of fluorine compounds, for example, polytetrafluoroethylene, polytrifluoroethylene, polyvinylidene fluoride, polyvinyl fluoride and the like. These fluorine compounds serve to inhibit the lowering of a resistance of the photosensitive member under highly humid environment. This is a result of an effective functioning of water repelling property of the fluorine compound. Thus properties required for the photosensitive member can be maintained and a stable image can be obtained even under highly humid environment.

The silicone resin which is provided on the photosensitive layer of the photosensitive member in Examples of the present invention, enhances abrasion resistance of the photosensitive member and durability of it in repeated use, and thereby a stable image can be obtained even in continuous use. Also moisture absorption through the surface of the photosensitive layer decreases to enhance moisture resistance.

As the silicone resins, there are ones for preparing a hard coating, for example, KP-85 of Shin-Etsu Chemical Co., Ltd., TOSGUARD of Toshiba Silicone Kabushiki Kaisha or the like.

Also antioxidants may be added to the photosensitive layer of the photosensitive member of the present invention in order to prevent the lowering of electrophotographic property of the photosensitive member due to ozone generated at the time of corona charging. As the antioxidants, there can be used, for example, silane coupling agent, titanate type coupling agent, and compounds containing a skeleton having a dialkylhydrolylphenyl group such as N,N'-diphenyl-p-phenylenediamine (DPPD), 1,3,5-trimethyl-2,4,6-tris (3,5-dibutyl-4-hydroxybenzyl) benzene, pentaerithrityl-tetrakis(3-(3,5-di-t-butyl-4-hydroxyphenyl) propionate), 1,6-hexanediol-bis(3-(3,5-di-t-butyl-4-hydroxyphenyl) propionate)triethyleneglycol-bis(3-(3-t-butyl-5-methyl-4-hydroxyphenyl) propionate), 2,4-bis-(n-octylthio)-6-(4-hydroxy-3,5-di-t-butylanilino)-1,3,5-triazine, 2,2-thio-diethylenebis(3-(3,5-di-t-butyl-4-hydroxyphenyl)propionate), octadecyl-3-(3,5-di-t-butyl-4-hydroxyphenyl) propionate, N,N'-hexamethylenebis (3,5-di-t-butyl-4-hydroxy-hydrocinnamide), 3,5-di-t-butyl-4-hydroxy-benzylphosphonate-diethylester, tris-(3,5-di-t-butyl-4-hydroxybenzyl)-isocyanulate and 2,4-bis( (octylthio)methyl)-0-cresol. The effect of these antioxidants can be recognized when added to the photosensitive layer in an amount of 0.01 to 5.0% by weight. A mixture of a plurality of these compounds may be used.

Also ozone decomposable compounds may be added to the photosensitive layer of the photosensitive member of the present invention in order to prevent the lowering of electrophotographic property of the photosensitive member due to ozone generated at the time of corona charging. Examples of the ozone decomposable compounds are, for instance, active oxygen quenchers such as α-tocopherol, β-carotene, ascorbic acid and bis(dimethylaminophenyl) (aminomethyldithion) nickel. The effect of these ozone decomposable compounds is recognized when added to the photosensitive layer in an amount of 0.01 to 5.0% by weight. A mixture of a plurality of these compounds may be used.

Since the photosensitive member of the present invention is deteriorated because of a mechanical friction during the developing, transferring and cleaning steps and also due to ozone generated from a charger during the charging step in the electrophotographic copying process, a protective layer may be provided on the photosensitive layer so as to be little affected thereby.

As the resins to be used for the protective layer, it is preferable to use thermosetting or photosetting resins produced by curing an acrylic resin, polyester resin, urethane resin, butyral resin, silicone resin, epoxy resin and the like by means of an amino resin, an isocyanate resin and the like.

Also the above-mentioned antioxidants and ozone decomposable compounds may be mixed into the resins to be used for the protective layer.

Further an electron accepting substance as a sensitizer may be added to the photosensitive layer of the photosensitive member of the present invention in order to enhance the photosensitivity. The electron accepting substances to be used as the sensitizer are, for example, tetracyanoethylene (TCNE), tetracyanoquinodimethane (TCNQ) and the like.

Also it is desirable that γ of the electrostatic latent image of the photosensitive layer for the photosensitive member of the present invention is at least 2 and less than 6. If the value γ is less than 2, an edge portion of the copied image becomes obscure, and this cannot conform to a high quality of the image required for the photosensitive member, and if the value γ is not less than 6, there occur problems of durability and moisture resistance when the photosensitive member is used repeatedly. It is further desirable that γ is not less than 3.0 and not more than 5.8 in order to give an excellent electrophotographic property.

Figure 4:
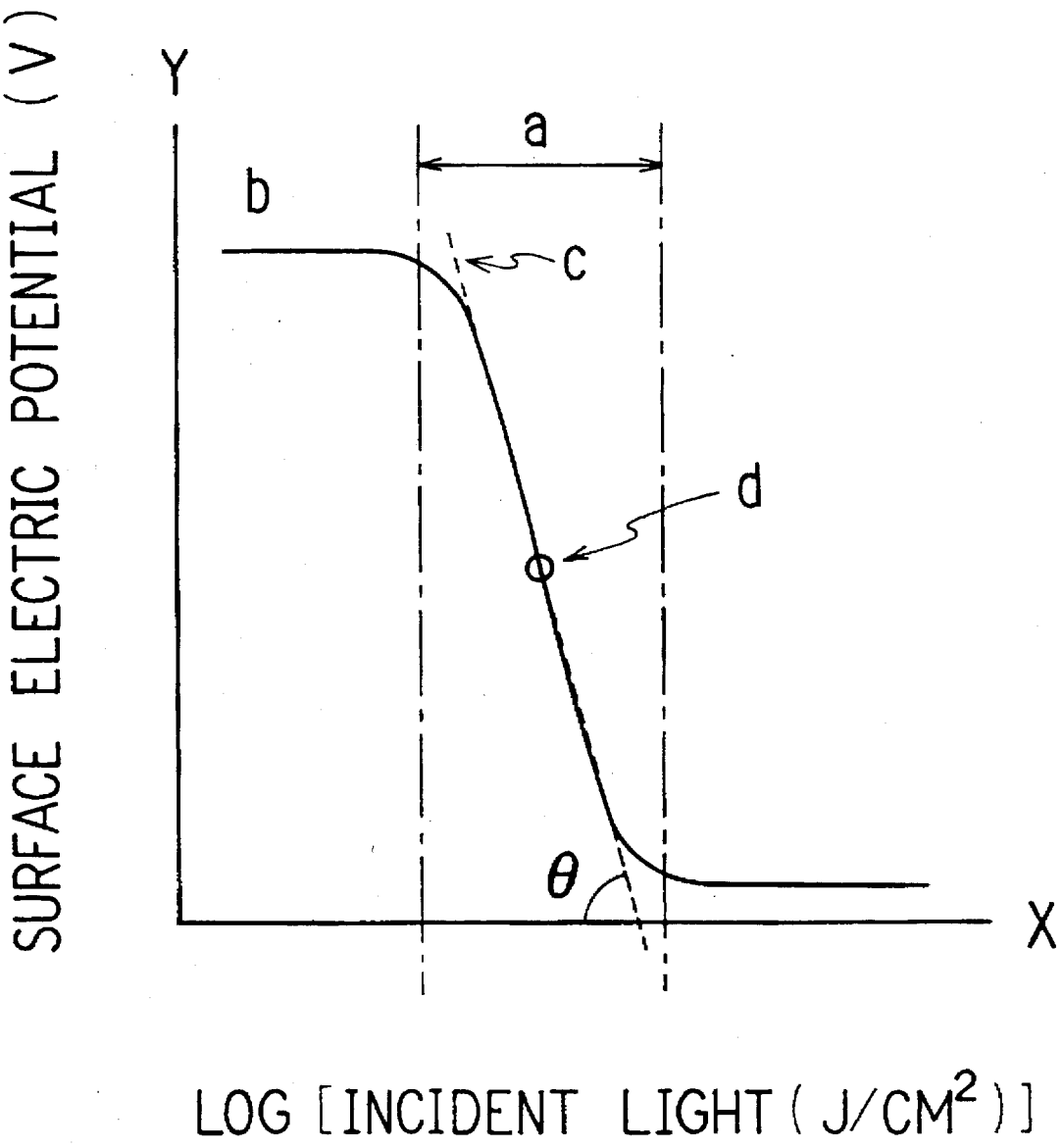
FIG. 4 is a characteristic curve showing a relation between the surface electric potential and the incident light of a photosensitive member for general uses.

The value γ (gamma) of the latent image in an electrophotography is one corresponding to a photographic density of a silver film. Electric potential on the charged photosensitive member decreases by an incident light. FIG. 4 is a characteristic curve showing a general relation of a surface electric potential and a quantity of an incident light of the photosensitive member. The electric potential is shown in a normal scale, and the quantity of the incident light is plotted by a logarithm. In the figure, X-axis shows the logarithm of the incident light ($J/cm^2$), and Y-axis shows the surface electric potential (V). In the figure, "a" is a region where the surface electric potential fluctuates rapidly, "b" is a surface electric potential-incident light curve, "c" is a straight line necessary for showing the value γ, "d" is an inflection point and θ is an angle formed by the straight line "c" and X-axis. The attenuation amount of electric potential is dependent on the quantity of the incident light but is not quite proportional to it. The electric potential is partly attenuated relatively rapidly by the incident light, and this is the range shown by "a" in FIG. 4. The relation of the density of the electrostatic latent image to the density of the visible image is regarded as 1:1, and the characteristic curve is illustrated so that, assuming the maximum density of the electrostatic latent image to correspond to the maximum density (OD 1.5) of an electrophotographic image, the scale from 0 to the maximum density of the electrostatic latent image (V max) on Y-axis is 1.5 times the unit scale, i.e. "1" on X-axis. In this case, provided that in the curve "b", the straight line "c" passes through the inflection point of the curve "b", and the angle formed by the line "c" drawn in line with the curve "b" as much as possible and the X-axis showing the logarithm of the incident light is θ, the value γ can be shown by tan θ using this angle θ.

EXAMPLE 1

Isophthalic acid and neopentyl glycol were introduced to a production device, that is to say, a 1,000 ml four-neck flask equipped with a stirrer, thermometer, inert gas blowing pipe and condenser, in an amount shown in Table 1, and were mixed and slowly heated with blowing the nitrogen gas therein at a flow rate of about 100 ml/min.

TABLE 1

| Polyester resin A | A-1 | A-2 | A-3 | A-4 |
|---|---|---|---|---|
| Isophthalic acid (g) | 132.8 | 59.8 | 119.5 | 99.6 |
| Phthalic anhydride (g) | 94.7 | 106.6 | 53.3 | 71.0 |
| Adipic acid (g) | 140.2 | 70.1 | 70.1 | 57.8 |
| Neopentyl glycol (g) | 292.5 | 137.5 | 137.5 | 141.5 |
| Ethylene glycol (g) | — | 32.2 | — | — |
| Propylene glycol (g) | — | — | 25.8 | — |
| Trimethylolpropane (g) | — | — | — | 25.8 |
| Acid value after synthesis | 20 | 10 | 15 | 18 |

Heating was carried out up to 190°±10° C. over about an hour, and with maintaining this temperature, when the dehydration amount had reached the value of not less than 90% of the theoretical dehydration amount, phthalic anhydride and adipic acid were added in the amounts shown in Table 1. Subsequently with maintaining the temperature at 190°±10° C., the heating was continued until the dehydration amount became not less than 90% of the theoretical dehydration amount and the acid value became not more than 25. Thus the polyester (resin A), A-1 to A-4 which are required as one component of a binder resin and contain a phthalic acid, isophthalic acid, adipic acid and neopentyl glycol as the essential components, were synthesized. FIG. 1 shows an elusion curve by GPC (gel permeation chromatograph) of the resin A-1 among the resins obtained in the above-mentioned manner in the blending mounts shown in Table 1. The GPC used for the measurement was one made by Toso Corporation (Trademark: HLC-8020).

Figure 2:
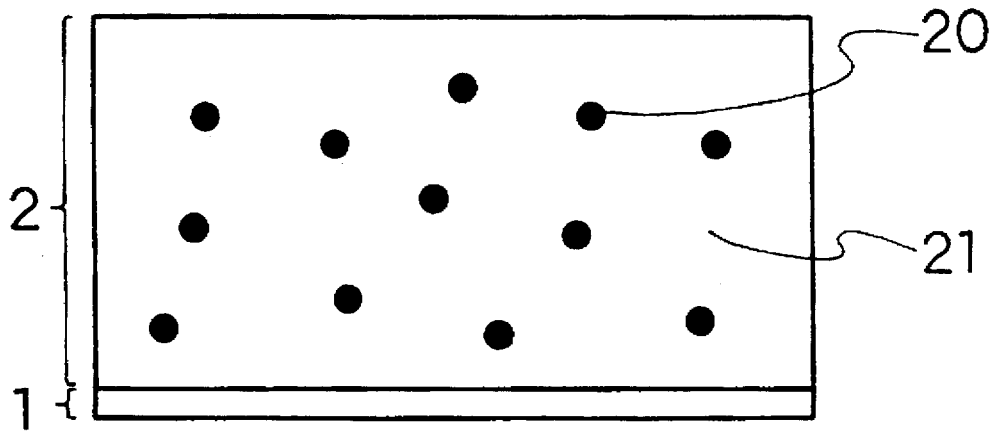
FIG. 2 is a configuration of the photosensitive member of one example of the present invention.

FIG. 2 is a configuration of the photosensitive member of one example of the present invention. Numeral 1 is a substrate and numeral 2 is a photosensitive layer. The photosensitive layer 2 is one comprising the binder resin 21 wherein the phthalocyanine type photoconductive compound 20 is dispersed. The binder resin is a mixture of the resin A (A-1 to A-4) and the resin B which is the binder resin other than the resin A.

This Example is further explained below. The substrate 1 shown in FIG. 2 indicates an aluminum plate or drum subjected to an alumite-treatment.

As shown in Table 2, there were mixed 14 g of X-form metal free phthalocyanine (X-H2PC) (made by Dainippon Ink & Chemicals, Inc. Trademark: Fastogen Blue 8120-BS) as the phthalocyanine type photoconductive compound, 1 g of the resin A shown in Table 1, i.e., resin A-1, 26.7 g of polyester resin B-1, i.e., the above-mentioned resin B (made by Toyobo Co., Ltd., registered trademark: VYRON RV-200 ), 3.9 g of polyester resin, i.e., resin B-2 (made by Mitsui Toatsu Chemicals, Inc., Trademark: ALMATEX P-645), 10.6 g of a butylated melamine resin (made by Mitsui Toatsu Chemicals, Inc., Trademark: UVAN 20HS) as the curing agent, 0.1 g of a tetracyanoethylene, 0.02 g of a silane coupling agent (made by Shin-Etsu Chemical Co., Ltd., trademark: KBM-403) and 60 g of a toluene and 200 g of MEK (methyl ethyl ketone) both as the solvents. Then the mixture was dispersed in a paint shaker for two hours to give a sensitizing solution.

TABLE 2

| | Ex.1 | Ex.2 | Ex.3 | Ex.4 | Ex.5 | Ex.6 |
|---|---|---|---|---|---|---|
| Essential component (g) | | | | | | |
| A-1 | 1.0 | — | — | — | — | — |
| A-2 | — | 1.0 | — | — | — | — |
| A-3 | — | — | 1.0 | — | — | — |
| A-4 | — | — | — | 4.9 | 2.0 | 1.5 |
| Resin B-1 (g) | 26.7 | 26.7 | 26.7 | 26.7 | 21.8 | 24.2 |
| Resin B-2 (g) | 3.9 | 3.9 | 3.9 | — | 5.3 | 3.3 |
| X-$H_2$PC (g) | 14.0 | 14.0 | 14.0 | 14.0 | 14.0 | 14.0 |
| Curing agent (g) | 10.6 | 10.6 | 10.6 | 10.6 | 10.6 | 10.6 |
| Solvent (g) | | | | | | |
| Toluene | 60.0 | 60.0 | 60.0 | 60.0 | 60.0 | 60.0 |
| MEK | 200.0 | 200.0 | 200.0 | 200.0 | 200.0 | 200.0 |

The sensitizing solution produced in the above-mentioned manner was dip-coated on the substrate 1 (polyamide layer on the aluminum plate), and after drying at normal temperature, the coated plate was dried at 150° C. for four hours for curing to give a test piece of the photosensitive member as one example of the present invention. In this case, the sensitizing solution was so coated that the thickness of the photosensitive layer 2 was from 12 to 16 μm. Also the photosensitive member in the form of a drum was produced in the same manner.

EXAMPLES 2 TO 6

The photosensitive member as the examples of the present invention were produced in the same maimer as in Example 1 except that the resin A, i.e., resins A-2 to A-4 obtained in Example 1 was mixed with the resins B-1 and B-2 used in Example 1 as shown in Table 2.

A durability test was carried out to check the durability of the photosensitive members, using the photosensitive member in the form of a drum obtained in the above example. In the durability test, at first measurements for electrophotographic properties (charging property, dark attenuation property and photosensitivity) were conducted, followed by repeating, 30,000 times, a cycle comprising charging, exposing, applying a negative bias and dissipating the charge. Afterwards, the durability was judged by checking to see if the above-mentioned electrophotographic properties were maintained at the practical level. In repeating the cycle, after adjusting the electric potential of the photosensitive member at the initial cycle at 610 V±20 V, electric current to the charger was fixed, light of 780 nm for exposing was irradiated at a rate of 2.5 μJ/cm$^2$, negative bias of −600 V was applied to the photosensitive member, and light for dissipating the charge was adjusted at 580 nm and 4 μJ/cm$^2$. Electric potential, dark attenuation and photosensitivity both after the initial cycle and after 30,000 cycles are shown in Table 3.

TABLE 3

| 25° C., 55% Rh | Ex.1 | Ex.2 | Ex.3 | Ex.4 | Ex.5 | Ex.6 |
|---|---|---|---|---|---|---|
| Initial cycle | | | | | | |
| Charging property | ☆ | ☆ | ☆ | ☆ | ☆ | ☆ |
| Dark attenuation | ☆ | ○ | ○ | ☆ | ○ | ○ |
| Photosensitivity | ☆ | ○ | ○ | ☆ | ☆ | ○ |
| After 30,000th cycle | | | | | | |
| Charging property | ☆ | ☆ | ☆ | ☆ | ☆ | ☆ |
| Dark attenuation | ○ | ○ | ○ | ☆ | ○ | ○ |
| Photosensitivity | ☆ | ○ | ○ | ☆ | ☆ | ○ |
| Y value | 5.0 | 3.5 | 3.3 | 4.5 | 5.4 | 3.0 |

In the above Table, the levels of the electrophotographic properties are shown by marks (☆○Δ><), the meanings and standards of which are shown in Table 4.

TABLE 4

Charging property

| | |
|---|---|
| ☆ | Capable of charging of not less than 700 V |
| ○ | Capable of charging of not less than 600 V |
| Δ | Capable of charging of not less than 500 V and less than 600 V |
| >< | Incapable of charging of not less than 500 V |

Dark attenuation property

| | |
|---|---|
| ☆ | Attenuation of electric potential: not more than 100 V in 1 second |
| ○ | Attenuation of electric potential: not more than 200 V in 1 second |
| Δ | Attenuation of electric potential: not more than 300 V in 1 second |
| >< | Attenuation of electric potential: more than 300 V in 1 second |

Photosensitivity

| | |
|---|---|
| ☆ | Residual potential in 0.5 sec. after exposure to light is not more than 100 V. |
| ○ | Residual potential in 0.5 sec. after exposure to light is not more than 200 V. |

TABLE 4-continued

| | |
|---|---|
| Δ | Residual potential in 0.5 sec. after exposure to light is not more than 300 V. |
| × | Residual potential in 0.5 sec. after exposure to light is more than 300 V. |

COMPARATIVE EXAMPLE 1

As shown in Table 5, 14 g of an X-form metal free phthalocyanine (X-H2PC) (Made by Dainippon Ink & Chemicals, Inc., Trademark: Fastogen Blue 8120-BS) as the phthalocyanine type photoconductive compounds, 29.6 g of the resin B-1 ( made by Toyobo Co., Ltd., Registered trademark: VYRON RV-200), 10.6 g of the butylated melamine resin (made by Sumitomo Chemical Co., Ltd. Registered trademark SUMIMAL M-40S), 0.1 g of tetracyanoethylene, 0.02 g of a silane coupling agent (made by Shin-Etsu Chemical Co., Ltd., Trademark: KBM-403 ), and 40 g of toluene and 200 g of MEK (methyl ethyl ketone) both as the solvents were incorporated and dispersed by means of a paint shaker for two hours to give a sensitizing solution.

TABLE 5

| | Com. Ex.1 | Com. Ex.2 | Com. Ex.3 | Com. Ex.4 | Com. Ex.5 |
|---|---|---|---|---|---|
| Essential component (g) | — | — | — | — | — |
| A-1 | — | — | — | — | — |
| A-2 | — | — | — | — | — |
| A-3 | — | — | — | — | — |
| A-4 | — | — | — | — | 37.0 |
| Resin B-1 (g) | 29.6 | — | — | 3.0 | — |
| Resin B-2 (g) | — | 49.3 | — | — | — |
| Resin B-3 (g) | — | — | 29.6 | 26.6 | — |
| X-$H_2$PC (g) | 14.0 | 14.0 | 14.0 | 14.0 | 14.0 |
| Curing agent (g) | 10.6 | 10.6 | 10.6 | 10.6 | — |
| Solvent (g) | | | | | |
| Toluene | 60.0 | 40.0 | 60.0 | 60.0 | 60.0 |
| MEK | 200.0 | 200.0 | 200.0 | 200.0 | 200.0 |

The sensitizing solution so prepared was dip-coated on the substrate 1 (polyamide layer on an aluminum plate), and after drying at normal temperature, the coated substrate was dried at 150° C. for four hours for curing to give a test piece of the photosensitive member. In this case, the sensitizing solution was coated so that the thickness of the photosensitive layer 2 is from 12 to μm. Also the photosensitive member in the form of a drum was produced in the same manner.

COMPARATIVE EXAMPLES 2 TO 5

A photosensitive member was produced in the same manner as in Comparative Example 1 except that the mixing amount of the materials was changed as shown in Table 5. In the table, resin B-3 is the above-mentioned resin B and is a butyral resin made by Sekisui Kagaku Kogyo Kabushiki Kaisha (Trademark: ESREC BM-S).

The same repeat tests as in Examples 1 to 6 were carried out for Comparative Examples 1 to 5, and the results are shown in Table 6. The marks in the table have the same meanings as those in Table 3.

Table 6

| 25° C. , 55% Rh | Com. Ex.1 | Com. Ex.2 | Com. Ex.3 | Com. Ex.4 | Com. Ex.5 |
|---|---|---|---|---|---|
| Initial cycle | | | | | |
| Charging property | ○ | ☆ | ○ | Δ | ○ |
| Dark attenuation | Δ | ☆ | Δ | Δ | × |
| Photosensitivity | ☆ | ☆ | ☆ | ○ | ○ |
| After 30,000th cycle | | | | | |
| Charging property | × | Δ | × | × | Δ |
| Dark attenuation | × | × | × | × | × |
| Photosensitivity | ☆ | ☆ | ☆ | ○ | ☆ |
| Y value | 10.1 | 6.5 | 12.5 | 7.4 | 6.3 |

From the above-mentioned measuring results of Examples and Comparative Examples, it is seen that the photosensitive members obtained in Examples 1 to 6 maintain the practical levels (☆, ○) of the electrophotographic properties required for the photosensitive member even after 30,000 cycles as shown in Table 3 and have a durability. On the contrary, it can be seen from Table 6 that after having repeated 30,000 cycles, the photosensitive members obtained in Comparative Examples 1 to 5 showed a lowered charging property and also an increased dark attenuation speed, and thus the properties do not satisfy the requirements for the photosensitive members.

EXAMPLE 7

Figure 3:
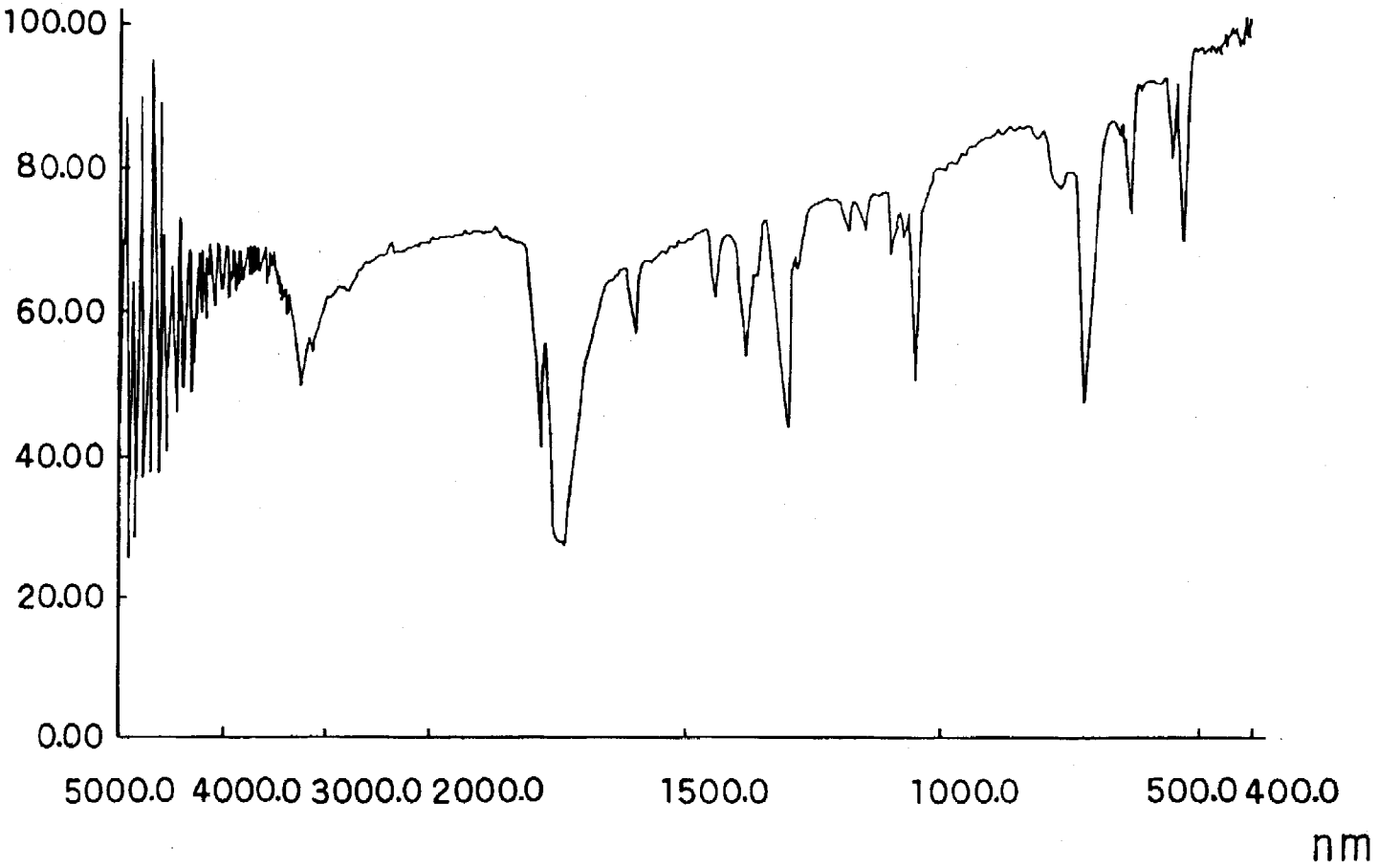
FIG. 3 is a graph showing an infrared absorption spectrum of a hygroscopic substance in the X-form metal free phthalocyanine with regard to one example of the present invention.

A photosensitive member as one example of the present invention was produced in the same manner as in Example 1 except that the X-form metal free phthalocyanine was cleaned and purified with a solvent, i.e., toluene. The purification of the X-form metal free phthalocyanine was carried out by dispersing an X-form metal free phthalocyanine powder in the toluene solution, stirring the solution by a propeller stirrer for about 30 minutes and then removing the solvent by means of a centrifugal separator. This purification step was repeated twice, followed by drying in an oven at 120° C. for 30 minutes. Impurities removed at that time was extracted by using water to give a hygroscopic substance, of which infrared absorption spectrum measured by means of an infrared spectrophotometer (made by Shimadzu Corporation, Trademark: FTIR-4300) is shown in FIG. 3. The repeat test stated in Example 1 was conducted, using the obtained photosensitive member, under highly humid environment (humidity 80% RH), and the results are shown in Table 7.

TABLE 7

| 30° C. , 80% Rh | Ex. 7 | Ex. 8 | Ex. 9 | Ex. 1 |
|---|---|---|---|---|
| Initial cycle | | | | |
| Charging property | ☆ | ☆ | ☆ | ☆ |
| Dark attenuation | ☆ | ☆ | ☆ | ☆ |
| Photosensitivity | ☆ | ☆ | ☆ | ☆ |
| After 30,000th cycle | | | | |
| Charging property | ☆ | ☆ | ☆ | ○ |
| Dark attenuation | ☆ | ☆ | ☆ | ○ |
| Photosensitivity | ☆ | ☆ | ☆ | ☆ |
| Y value | 4.8 | 4.3 | 5.0 | 5.0 |

EXAMPLE 8

A photosensitive member as one example of the present invention was produced in the same manner as in Example 1 except that 10% by weight of solid polytetrafluoroethylene (made by Daikin Industries, Ltd., Trademark LUBRON L-2) was added to the photosensitive layer of the photosensitive member. The repeat test stated in Example 1 was conducted using the thus obtained photosensitive member under highly humid environment (humidity 80% RH), and the results are shown in Table 7.

EXAMPLE 9

The photosensitive member as one example of the present invention was produced in the same manner as in Example 1 except that a primer. (made by Shin-Etsu Chemical Co., Ltd., Trademark: PRIMER PC-5) was coated on the photosensitive layer of the photosensitive member, and then silicone resin (made by Shin-Etsu Chemical Co., Ltd., Trademark: Hard Coating Agent KP-85) was coated thereon. For the thus obtained photosensitive member, the repeat test stated in Example 1 was conducted under highly humid environment (humidity 80% RH), and the results are shown in Table 7.

As it can be seen from Table 7, the photosensitive members obtained in Examples 7 to 9 have excellent electrophotographic properties even under highly humid environment and further maintain such excellent properties even after the repeat test under highly humid environment. This indicates that the photosensitive members obtained in Examples 7 to 9 are those excellent also in moisture resistance.

What we claim is:

1. A photosensitive member having a photosensitive layer comprising:

a binder resin in which a phthalocyanine photoconductive compound is dispersed;

wherein said binder resin comprises two or more resins of which at least one of said resins is a polyester resin A synthesized from components comprising:

phthalic acid or phthalic anhydride;

isophthalic acid;

adipic acid; and neopentyl glycol.

2. The photosensitive member of claim 1, wherein a ratio of the resin A to a binder resin B which is other than the resin A is 1:1 to 40.

3. The photosensitive member of claim 1, wherein said phthalocyanine photoconductive compound is present in the binder resin in an amount of 15 to 40% by weight.

4. The photosensitive member of claim 2, wherein said phthalocyanine photoconductive compound is present in the binder resin in an amount of 15 to 40% by weight.

5. The photosensitive member of claim 1, wherein a thickness of the photosensitive layer is from 5 to 30 μm.

6. The photosensitive member of claim 1, wherein said photosensitive layer contains a fluorine compound.

7. The photosensitive member of claim 1, wherein a protective layer is provided on said photosensitive layer.

8. The photosensitive layer of claim 7, wherein said protective layer contains a silicone resin.

9. The photosensitive member of claim 6, wherein a protective layer is provided on said photosensitive layer.

10. The photosensitive layer of claim 9, wherein said protective layer contains a silicone resin.

11. A method of producing the photosensitive member, wherein a hygroscopic substance is removed from a dispersed phase containing an X-form metal free phthalocyanine as a main component and then said dispersed phase is mixed and dispersed in the resin binder of claim 1.

12. A method of producing the photosensitive member, wherein a hygroscopic substance is removed from a dispersed phase containing an X-form metal free phthalocyanine as a main component and then said dispersed phase is mixed and dispersed in the resin binder of claim 2.

13. The photosensitive member of claim 1, wherein said phthalocyanine photoconductive compound is selected from the group consisting of: aluminum phthalocyanine, aluminum polychlorophthalocyanine, antimony phthalocyanine, barium phthalocyanine, beryllium phthalocyanine, cadmium phthalocyanine, cadmium hexadecachlorophthalocyanine, calcium phthalocyanine, cerium phthalocyanine, chromium phthalocyanine, cobalt phthalocyanine, cobalt chlorophthalocyanine, copper 4-bromochlorophthalocyanine, copper 4-aminophthalocyanine, copper bromochlorophthalocyanine, copper 4-chlorophthalocyanine, copper 4-nitrophthalocyanine, copper phthalocyanine sulfonate, copper polychlorophthalocyanine, deuteriophthalocyanine, dysprosium phthalocyanine, erbium phthalocyanine, europium phthalocyanine, gadolinium phthalocyanine, gallium phthalocyanine, germanium phthalocyanine, hafnium phthalocyanine, halogen substituted phthalocyanine, holmium phthalocyanine, indium phthalocyanine, iron phthalocyanine, iron polyhalophthalocyanine, lanthanum phthalocyanine, lead phthalocyanine, lead polychlorophthalocyanine, cobalt hexaphenylphthalocyanine, copper pentaphenylphthalocyanine, lithium phthalocyanine, lutecium phthalocyanine, magnesium phthalocyanine, manganese phthalocyanine, mercury phthalocyanine, molybdenum phthalocyanine, naphthalocyanine, neodymium phthalocyanine, nickel phthalocyanine, nickel polyhalophthalocyanine, osmium phthalocyanine, palladium phthalocyanine, palladium cholorphthalocyanine, alkoxyphthalocyanine, alkylaminophthalocyanine, alkylmercaptophthalocyanine, aralkylaminophthalocyanine, aryloxyphthalocyanine, arylmercaptophthalocyanine, copperphthalocyanine, piperidine phthalocyanine, cycloalkylaminophthalocyanine, dialkylaminophthalocyanine, diaralkylaminophthalocyanine, dicycloalkylaminophthalocyanine, hexadecahydrophthalocyanine, imidomethylphthalocyanine, 1,2-naphthalocyanine, 2,3-naphthalocyanine, octaazaphthalocyanine, sulfur phthalocyanine, tetraazaphthalocyanine, tetra-4-acetylaminophthalocyanine, tetra-4-aminobenzoylphthalocyanine, tetra-4-aminophthalocyanine, tetrachloromethylphthalocyanine, tetradiazophthalocyanine, tetra-4,4-dimethyloctaazaphthalocyanine, tetra-4,5-diphenyloctaazaphthalocyanine, tetra-(6-methylbenzothiazoyl)phthalocyanine, tetra-p-methylphenylaminophthalocyanine, tetramethylphthalocyanine, tetra-naphthotriazolylphthalocyanine, tetra-4-naphthylphthalocyanine, tetra-4-nitrophthalocyanine, tetra-peri-naphthylene-4,5-octaazaphthalocyanine, tetra-2,3-phenyleneoxide phthalocyanine, tetra-4-phenyloctaazaphthalocyanine, tetraphenylphthalocyanine tetracarboxylic acid, tetraphenylphthalocyanine tetrabarium carboxylate, tetraphenylphthalocyanine tetra-calcium carboxylate, tetrapyridyphthalocyanine, tetra-4-trifluoromethylmercaptophthalocyanine, tetra-4-trifluoromethylphthalocyanine, 4,5-thionaphthene-octaazaphthalocyanine, platinum phthalocyanine, potassium phthalocyanine, rhodium phthalocyanine, samerium phthalocyanine, silver phthalocyanine, silicone phthalocyanine, sodium phthalocyanine, sulfonated phthalocyanine, thorium phthalocyanine, thuliumphthalocyanine, tin phthalocyanine, tin chlorophthalocyanine, titanyl phthalocyanine, hydroxygallium phthalocyanine, metal free phthalocyanine and a mixture thereof.

* * * * *